US005577362A

United States Patent [19]

Yamashita et al.

[11] Patent Number: 5,577,362

[45] Date of Patent: Nov. 26, 1996

[54] MODULE CONSTRUCTION METHOD IN A STEEL STRUCTURE BUILDING ZONE

[75] Inventors: Kazukuni Yamashita; Shigetoshi Hikizi; Tamotsu Takano; Naomichi Ohama; Yoshiyuki Tanaka; Tominari Tsukiyama; Tsukasa Takahashi; Mitsumasa Hori; Hideyuki Yoshioka, all of Nagasaki, Japan

[73] Assignee: Mitsubishi Jukogyo Kabushiki Kaisha, Tokyo, Japan

[21] Appl. No.: 367,249

[22] PCT Filed: May 13, 1994

[86] PCT No.: PCT/JP94/00777

§ 371 Date: Jan. 12, 1995

§ 102(e) Date: Jan. 12, 1995

[87] PCT Pub. No.: WO94/27003

PCT Pub. Date: Nov. 24, 1994

[30] Foreign Application Priority Data

May 14, 1993 [JP] Japan ..... 5-113072
Jan. 12, 1994 [JP] Japan ..... 6-001603

[51] Int. Cl.[6] ..... E04B 1/34

[52] U.S. Cl. ..... 52/745.03; 52/745.1; 52/745.05; 52/745.09; 52/745.04

[58] Field of Search ..... 52/745.09, 745.1, 52/745.04, 745.03, 745.05; 405/195.1, 204; 166/301

[56] References Cited

U.S. PATENT DOCUMENTS 3,863,418 2/1975 Foucheux ..... 52/745.04

FOREIGN PATENT DOCUMENTS 1454043 9/1966 France .
2214019 8/1974 France .
52-26044 12/1977 Japan .
3-26262 10/1991 Japan .
4-257602 11/1992 Japan .
5-33515 9/1993 Japan .
1293689 10/1972 United Kingdom .

OTHER PUBLICATIONS

Patent Abstracts of Japan, vol. 16, No. 456 (M–1314) Sep. 22, 1992 & JP–A–04 161631 (Ohbayashi Corp) Jun. 5, 1992.

*Primary Examiner*—Lanna Mai
*Assistant Examiner*—W. Glenn Edwards
*Attorney, Agent, or Firm*—Jacobson, Price, Holman & Stern, PLLC

[57] ABSTRACT

A module construction method in a steel structure building zone, including steps of: erecting truss column assemblies (1A), (1B) formed by arranging and joining a plurality of pillars; installing a truss beam assembly (1C) between the tops of the two truss column assemblies (1A), (1B) erected in parallel to construct a gate-shaped truss assembly (1D); installing the gate-shaped truss assemblies (1D) in opposition to fit in with the shape of the steel structure; and installing modules (6A), (6B), (6C) . . . in the construction zone formed between the gate-shaped truss assemblies (1D) by repeating a process in which, among modules to be installed in the construction zone formed between the gate-shaped truss assemblies (1D) installed in opposition, a first module (6A) to be located at a high place is carried in to the construction zone and lifted to a position higher than the height of a second module (6B) installed just under the first module (6A) by using a first elevating device installed at the side of said gate-shaped truss assembly (1D), a second module (6B) is carried in just under the first module (6A) to integrate both modules (6A), (6B), and a third module (6C) is carried in just under the integrated modules and joined to them.

5 Claims, 14 Drawing Sheets

MODULE CONSTRUCTION METHOD IN A STEEL STRUCTURE BUILDING ZONE

DESCRIPTION

1. Technical Field

The present invention relates to a module construction method in a steel structure building zone, which can be applied to the assembly and construction of steel buildings and the assembly and installation of power generating sets, steel making machines, or paper making machines, or apparatuses and equipment for chemical plants etc. which are installed in the buildings.

2. Background Art

The module construction methods in a steel structure building zone shown in FIGS. 26 and 27 have so far been used.

The method shown in FIG. 26 is called a pile-up method, in which a member 021 forming a steel building 02 or an apparatus 03 to be installed in the steel building is lifted and transported for installation and assembly as a single item or a block forming a certain small section by using a crane 01 installed on the ground.

The method shown in FIG. 27 is called a push-up method in which after a roof 06 and a top floor 07 are completed, they are raised (jacked up) by using hydraulic equipment etc. to produce a space for installing the next floor under the top floor 07, the next floor to be connected to the top floor 07 is built in this space, the roof 06 and the top floor 07 is lowered (jacked down) to incorporate with the lower floor, and the incorporated structure is jacked up to produce a space for installing the next floor under the incorporated structure, thus the building structure is assembled successively.

In FIG. 27, reference numeral 08 denotes an external protective cover, 09 denotes a material carrying unit, and 010 denotes a slide strut.

(1) With the above-described pile-up method, the weight and size of a single item of apparatus or a block formed by incorporating the items are limited by the crane capacity such as working radius, lifting capacity, lifting height, and lift, so that the work efficiency is decreased. When the building and the apparatus to be installed in the building are assembled separately, it is necessary to provide an upper or a side space for transportation to the place where the apparatus is installed. Therefore, the term of works is extended due to the adjustment of the work schedule or the work progress and for other reasons.

Even when there is no limit of crane capacity and the building and the apparatus to be installed in the building can be assembled as a block, the next step cannot sometime be performed because of the relationship between the floors.

(2) With the above-described push-up method, the next step cannot be performed before the entire floor is completed. For example, if a trouble occurs in a zone on one floor, jacking up cannot be performed before that floor is completed, so that the work for the next floor cannot be started, causing waiting time. An object of the present invention is to provide a module construction method in a steel structure building zone which solves the above problems with the conventional methods. With the method of the present invention, a block can be carried in from one direction and joining and lifting by jacking up can be performed for the steel structure of any shape. Therefore, work can be done up to the maximum limit of jack capacity without being restricted. In addition, since a steel structure can be constructed by being divided into zones, work can be done independently for each zone. If a trouble occurs or the progress of work is behind schedule in one zone, the work in other zones is not affected.

DISCLOSURE OF THE INVENTION

Accordingly, according to the present invention defined in claim 1, (1) The module construction method includes the steps of: erecting a truss column assembly which is formed as one column by joining several pillars with beams, vertical braces, and horizontal braces; constructing a gate-shaped truss assembly by installing hydraulic jacks as a first elevating device on top of two truss column assemblies assembled to the top floor, by joining a plurality of beam members, which are carried on the ground between the truss column assemblies, with vertical and horizontal braces, and by lifting the truss beam assembly formed into one beam to the top of the truss column assembly; arranging the gate-shaped truss assemblies in opposition to fit in with the planar shape of the steel structure to be constructed; and installing modules in the construction zone by performing a process in which, among modules to be installed in the construction zone formed between the gate-shaped truss assemblies arranged in opposition, a first module of one to several floors including floor, walls, and equipment is assembled, the assembled module is joined to jack rods connected to the hydraulic jacks and jacked up, a second module to be installed just under the first module is carried in or assembled and joined to the first module, and similarly a module to be installed under the assembled modules is integrated and pulled up.

According to the present invention defined in claim 2, (2) The module construction method includes the steps of: erecting the truss column assembly; constructing the gate-shaped truss assembly; arranging the gate-shaped truss assemblies in opposition; joining both ends of a permanent support beam to the opposed sides of the truss beam assembly forming the gate-shaped truss assembly by lifting the permanent support beam to the top of the gate-shaped truss assembly between the gate-shaped truss assemblies arranged in opposition by using a first elevating device; and installing modules in the construction zone by performing a process in which, among modules to be installed in the construction zone formed between the gate-shaped truss assemblies arranged in opposition, a first module of one to several floors including floor, walls, and equipment is assembled, the assembled module is joined to jack rods connected to the hydraulic jacks and jacked up, a second module to be installed just under the first module is carried in or assembled and joined to the first module, and similarly a module to be installed under the joined modules is integrated and pulled up.

According to the present invention defined in claim 3, in addition to the steps described in the above items (1) and (2), (3) The module construction method includes the step of installing structure blocks in the construction zone under the gate-shaped truss assembly by performing a process in which, among structure blocks to be housed in the construction zone located under the gate-shaped truss assemblies, a first structure block of one to several floors including floor, walls, and equipment is assembled, the assembled structure block is jacked up by using the first elevating device provided on top of the gate-shaped truss assembly, a second structure block to be installed just under the first structure block is carried in or assembled and joined to the first structure block, and similarly a structure block to be installed under the joined structure blocks is integrated and pulled up.

According to the present invention defined in claim 4, in addition to the steps described in the above item (3), (4) The module construction method includes the step in which after one of the modules or structure blocks manufactured so that the height of corresponding floor is equal is installed in the construction zone formed between the gate-shaped truss assemblies to be installed or under the gate-shaped truss assembly, the other module or structure is lifted to a required height in the construction zone to which they are installed by using the first or second elevating device, and is joined with beams and horizontal braces with the corresponding floors being at the same level.

According to the present invention defined in claim 5, in addition to the steps described in the above item (3), (5) The module construction method includes the step in which the process of installing modules in the construction zone and the process of installing structure blocks are performed independently without mutual interference so that work in other processes does not interfere with the carrying-in of a module or structure block to the construction zone and the installation work in each process.

According to the module construction method in a steel structure building zone in accordance with the present invention, (1) The combination of a truss column assembly and a truss beam assembly into a gate-shaped truss assembly increases rigidity. The incorporation of a first elevating device consisting of hydraulic jacks and step rods in the gate-shaped truss assembly eliminates the need for a crane, by which the increase in work efficiency, which has been hindered by crane capacity, can be achieved.

Further, a steel structure of any shape, area, and height can be built by the combination of gate-shaped truss assemblies.

Further, since one construction zone is formed by opposed gate-shaped truss assemblies, one zone does not interfere with the lifting in another zone, so that work can be carried out for each zone, which eliminates the need for coordination of work progress and shortens the term of work.

Further, a very large steel structure can be built by changing installation sequence of modules between zones depending on the limitation condition of carrying-in entrance etc.

Still further, since the assembly is performed by repeating assembly of a lower module to an upper module and jacking up, the construction can be carried out even when the work space is limited and there is no space where modules are made a block in advance.

Also, according to the module construction method in a steel structure building zone in accordance with another mode of the present invention, in addition to the above item (1), (2) Since a permanent support beam is installed on top of the gate-shaped truss assemblies arranged in opposition and a module is lifted by using a second elevating device installed on the permanent support beam and assembled, even a module to be arranged at the same height can be assembled by dividing arbitrarily, so that work efficiency can be improved. When a module is lifted, vertical lifting is possible, without lifting in the oblique direction, so that the lifting capacity of the second elevating device is increased, and the operation of the device can be performed smoothly, by which the installation work of a module is made easy.

Further, the assembly of the gate-shaped truss assembly and the permanent support beam increases the rigidity of the structure for lifting a module, which allows the lifting and installation of a heavier module.

Also, according to the module construction method in a steel structure building zone in accordance with another mode of the present invention, in addition to the above item (1) or (2), (3) Not only does the installation of a structure block in the construction zone under the gate-shaped truss assembly become easy, but the rigidity strength of the gate-shaped truss assembly can also be increased.

In particular, if the module in the construction zone between the opposed gate-shaped truss assemblies is installed after a structure block is installed, a heavy module can be lifted and installed as compared with the strength of the gate-shaped truss assembly.

Also, according to the module construction method in a steel structure building zone in accordance with another mode of the present invention, in addition to the above items (1), (2), and (3) or the above items (1) and (3), (4) The construction of a steel structure in the construction zone in wider range can be carried out, and the adjustment of floor height of a module and a structure block after construction becomes unnecessary, so that the term of work can be further shortened.

Also, according to the module construction method in a steel structure building zone in accordance with another mode of the present invention, in addition to the above items (1), (2), and (3) or the above items (1) and (3), (5) The work for installing modules and structure blocks does not become complicated, so that the adjustment of work scheduling and work progress becomes unnecessary, by which the work efficiency is enhanced.

According to the above-described module construction method in a steel structure building zone in accordance with the present invention, the following effects can be achieved by the configuration shown in claims.

(1) A steel structure of any shape, area, and height can be built.

(2) By using jacks in place of a crane, whose capacity is limited, a large block can be adopted in accordance with all zones, so that the work efficiency can be increased.

(3) Since a block is made on the ground or at a low place near the ground, a floor, walls, and contents can be installed safely and rapidly.

(4) Since work can be done independently in each zone, work can be performed regardless of any trouble in other zones. Therefore, a short-term operation can easily be assured, and split order can be placed for each zone.

(5) The critical path point in the work procedure is clear, so that the work progress control can be carried out easily.

(6) When the site area is limited, a block can be assembled at a fixed position on the ground, and installed by repeating the joining to the upper block. Therefore, this method is flexible.

BRIEF DESCRIPTION OF THE DRAWINGS

FIG. 5 is a view showing a state in which a structure block to be installed under the gate-shaped truss assembly is carried in;

BEST MODE FOR CARRYING OUT THE INVENTION

Figure 1:
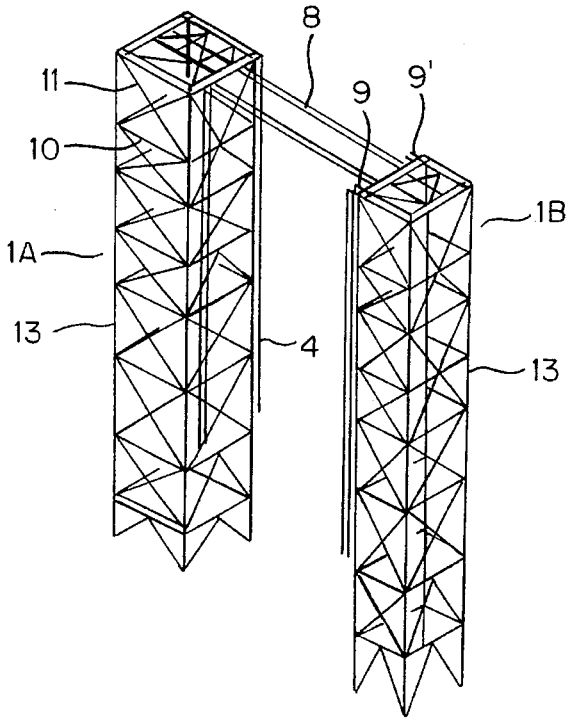
FIG. 1 is a view showing the construction of a truss column assembly in accordance with one embodiment of a module construction method in a steel structure building zone of the present invention.

One embodiment of a module construction method in a steel structure building zone in accordance with the present invention will be described below with reference to the drawings.

Truss column assemblies 1A and 1B each of which is assembled by a plurality of pillars 13, beams 10, and horizontal braces 11 of a single item or a block, and vertical braces 15 in FIG. 3, described later, are erected by a crane (not shown). The floors in the truss column assemblies 1A and 1B and the contents on the floors are incorporated at an appropriate time in this erection process.

The truss column assemblies 1A and 1B are assembled up to the top floor, and then a connecting passage 8, which is also used for adjusting the span, is installed at the upper part of these two truss column assemblies 1A and 1B.

Figure 3:
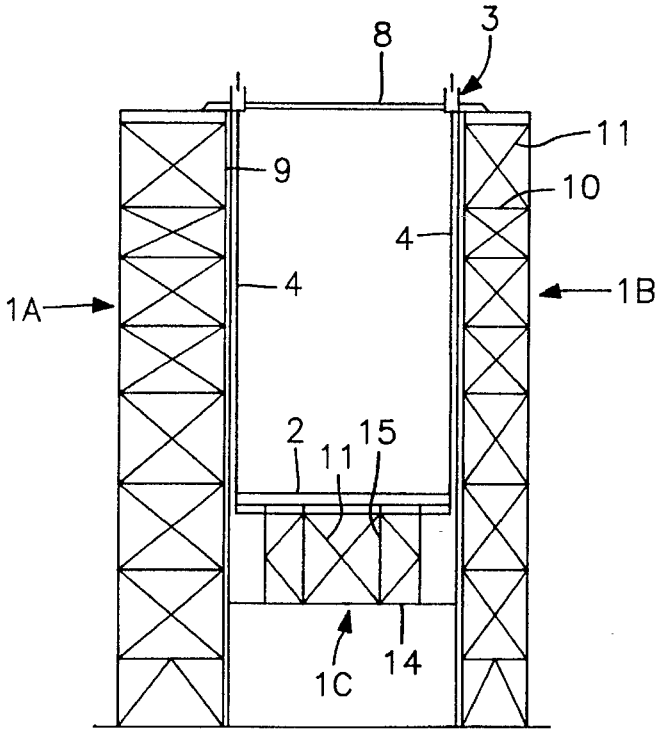
FIG. 3 is a view showing a state in which the truss beam assembly shown in FIG. 2 is lifted.

As shown in FIG. 3, hydraulic jacks 3 are installed at the upper part on the opposite side of the truss column assembly 1A, 1B. Also, jack rods 4, each of which is driven by the hydraulic jack 3, a first elevating device, are hung from core steel frames 9 on the opposite side of each of the truss column assemblies 1A and 1B.

Figure 2:
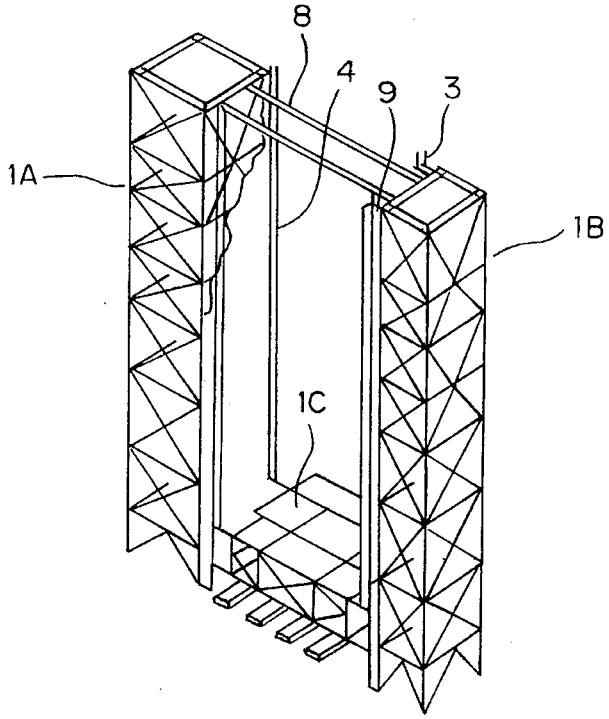
FIG. 2 is a view showing a state in which a truss beam assembly is carried in between the truss column assemblies shown in FIG. 1.

Next, as shown in FIGS. 2 and 3, a truss beam assembly 1C, which is formed by connecting a plurality of beam members 14 by using vertical braces 15 and horizontal braces 11, is carried in between the truss column assemblies 1A and 1B, and the jack rods 4 are connected to a temporary support frame 2 installed on top of the truss beam assembly 1C.

Figure 4:
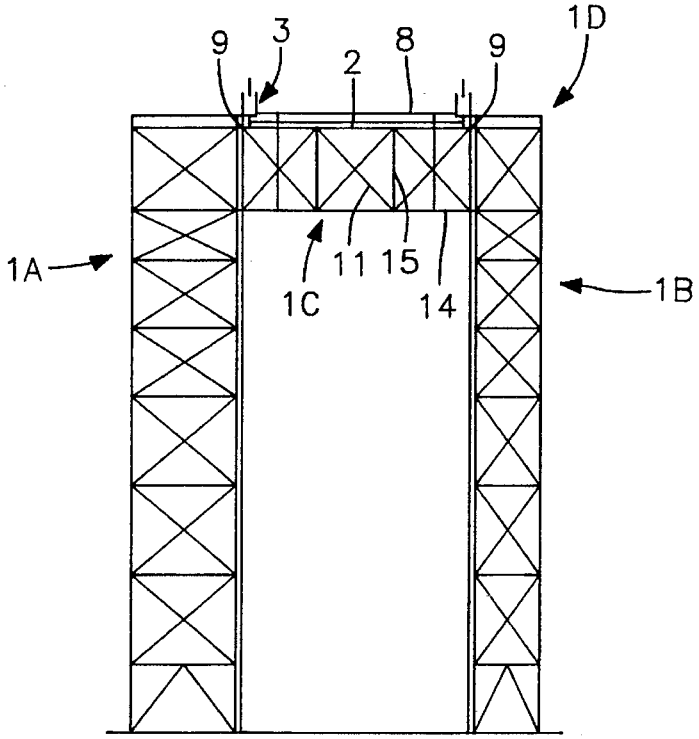
FIG. 4 is a front view of a gate-shaped truss assembly.

Then, as shown in FIGS. 3 and 4, the truss beam assembly 1C together with the temporary support frame 2 is jacked up to the top of the truss column assemblies 1A and 1B by the jack rods 4 driven by the jacks 3. After that, both ends of the truss beam assembly 1C are joined to the truss column assemblies 1A and 1B to form a gate-shaped truss assembly 1D.

Figure 5:
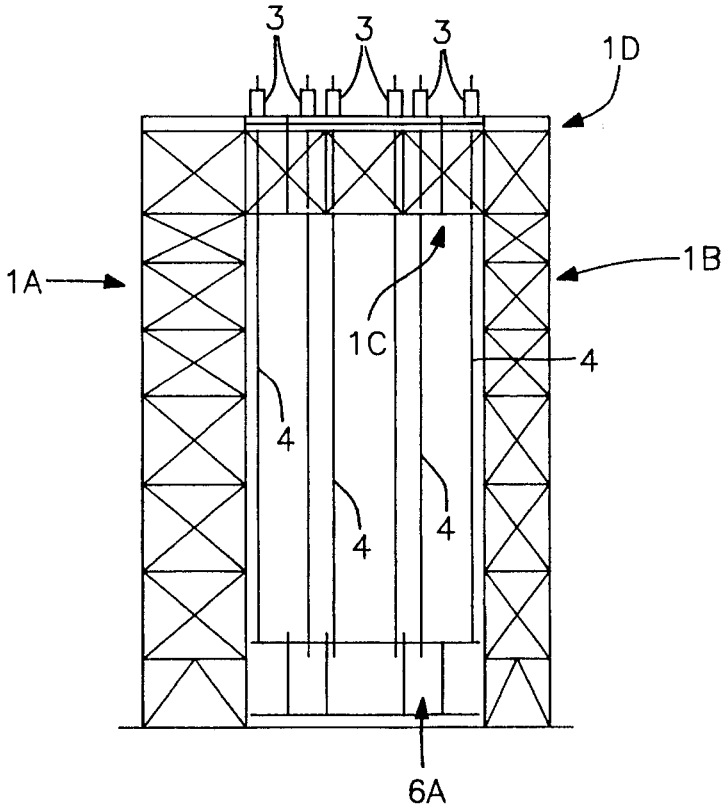

Afterwards, as shown in FIG. 5, among the modules to be installed in the construction zone between the truss column assemblies 1A and 1B, that is, in the gate-shaped truss assembly, a top block 6A, which has been assembled including a floor, walls, and contents as a first structure block located at a high place, is carried in between the truss column assemblies 1A and 1B, and connected to the jack rods 4. When the top block 6A has a heavy weight and a long span, an appropriate number of jacks 3 and jack rods 4 are installed on the temporary support frame 2, which is temporarily welded onto the truss beam assembly 1C as shown in the figure to be used for jacking up the truss beam assembly 1C.

Figure 6:
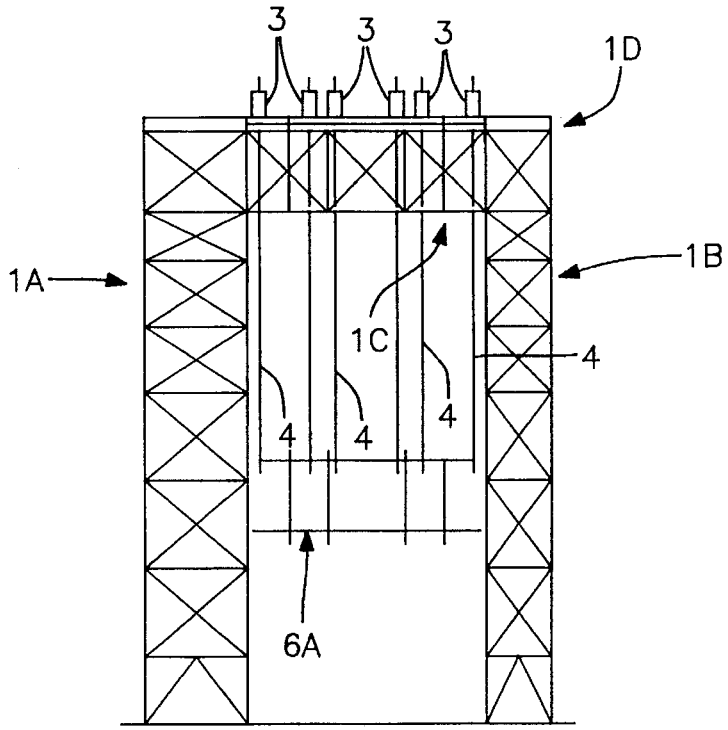
FIG. 6 is a view showing a state in which the structure block shown in FIG. 5 is lifted.

Then, as shown in FIG. 6, the top block 6A is jacked up to a height at which there is no interference in carrying in the next block 6B located just under the top block 6A.

Figure 7:
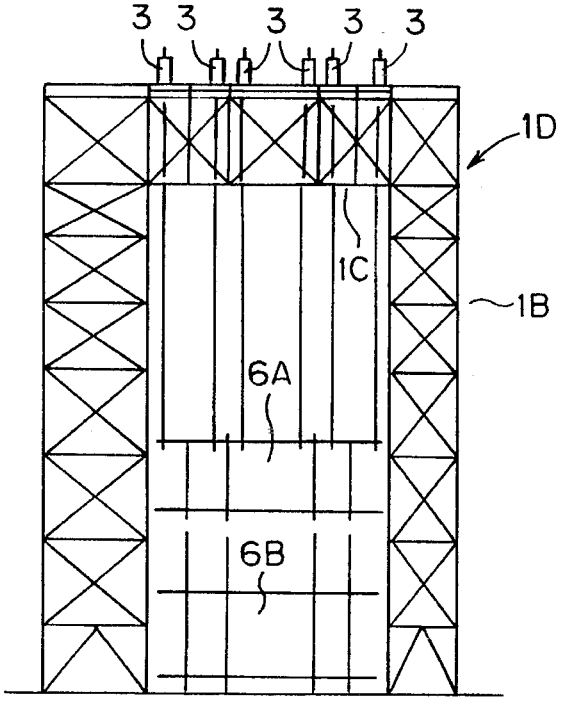
FIG. 7 is a view showing a state in which the next structure block is carried in under the lifted structure block of FIG. 5.
Figure 8:
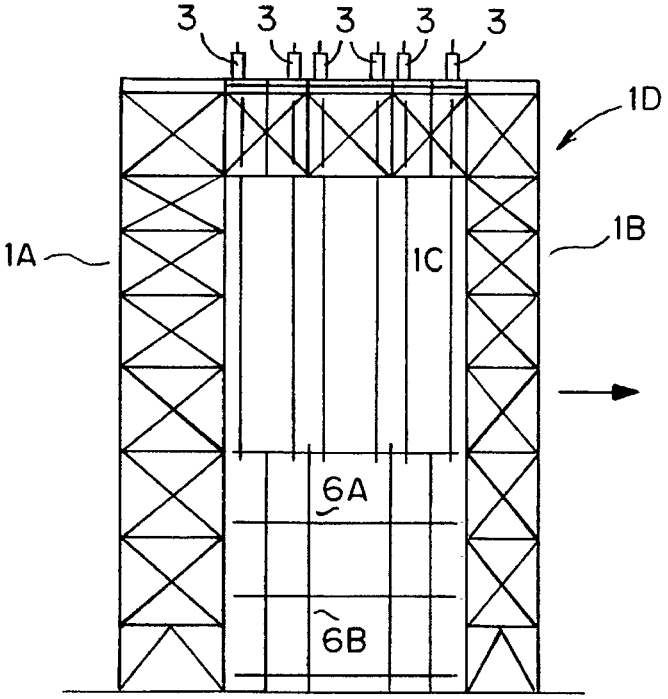
FIG. 8 is a view showing a state in which two structure blocks shown in FIG. 7 are joined.

Thereafter, as shown in FIG. 7, the next block 6B is carried in between the truss column assemblies 1A and 1B. Then, as shown in FIG. 8, the jack rods 4 are jacked down to allow the top block 6A to rest on the block 6B, and both blocks are connected by connecting hardware (not shown) to form one unit.

Figure 9:
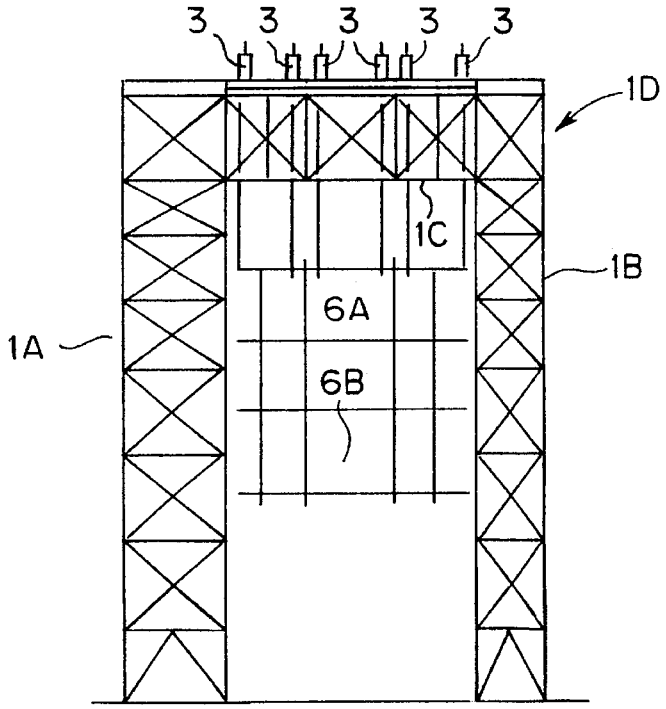
FIG. 9 is a view showing a state in which the joined structure block of FIG. 8 is lifted.
Figure 10:
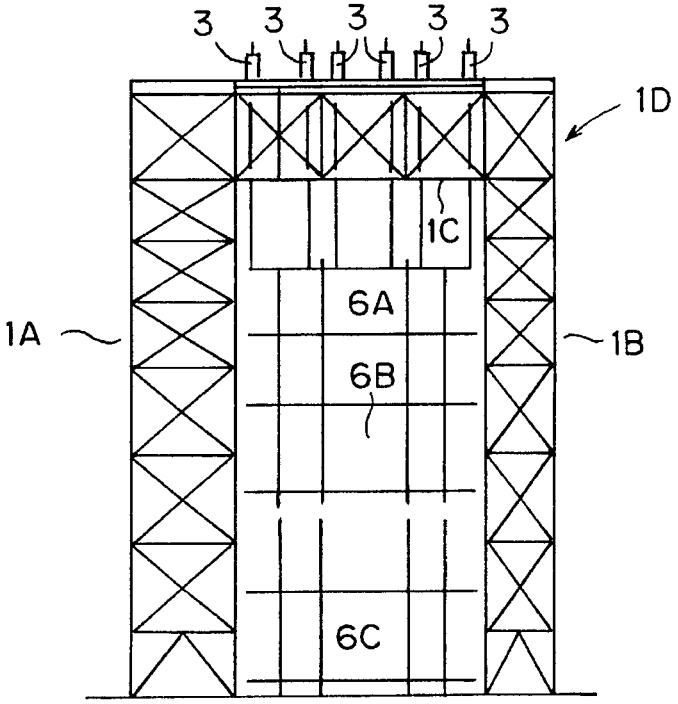
FIG. 10 is a view showing a state in which the next structure block is carried in under the lifted structure block of FIG. 9.
Figure 11:
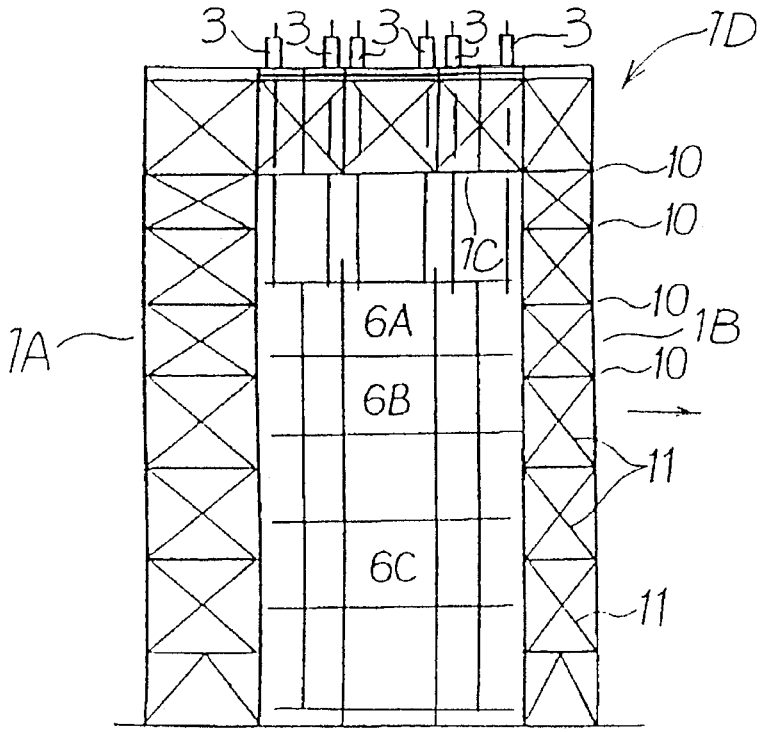
FIG. 11 is a view showing a state in which three structure blocks of FIG. 10 are joined.

In the same way, to connect and integrate the next block 6C, a process of jacking up, carrying in, and joining is repeated as shown in FIGS. 9 to 11.

Figure 12:
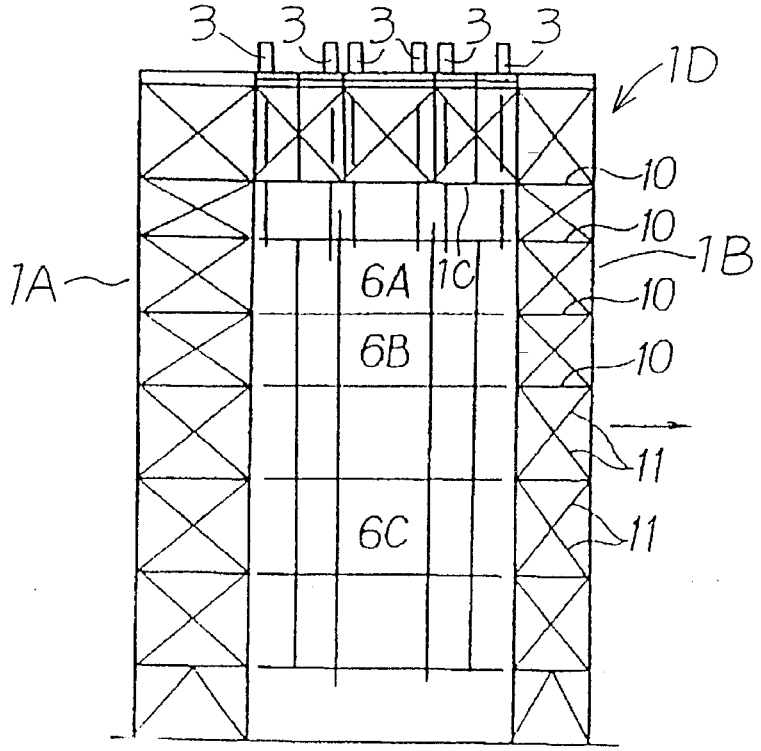
FIG. 12 is a view showing a state in which the structure block shown in FIG. 11 is lifted up to the corresponding floor.
Figure 13:
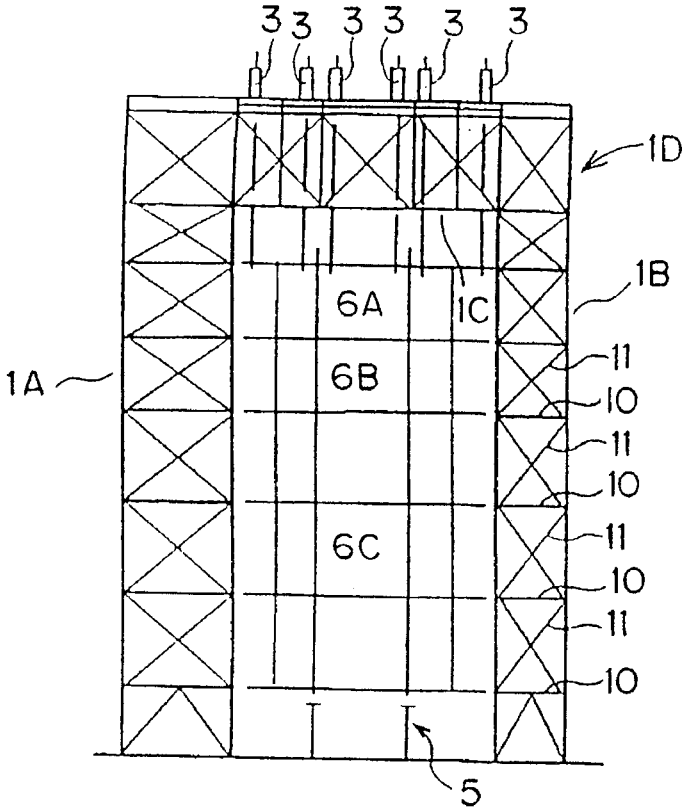
FIG. 13 is a view showing a state in which lower short pillars are inserted under the structure block.
Figure 14:
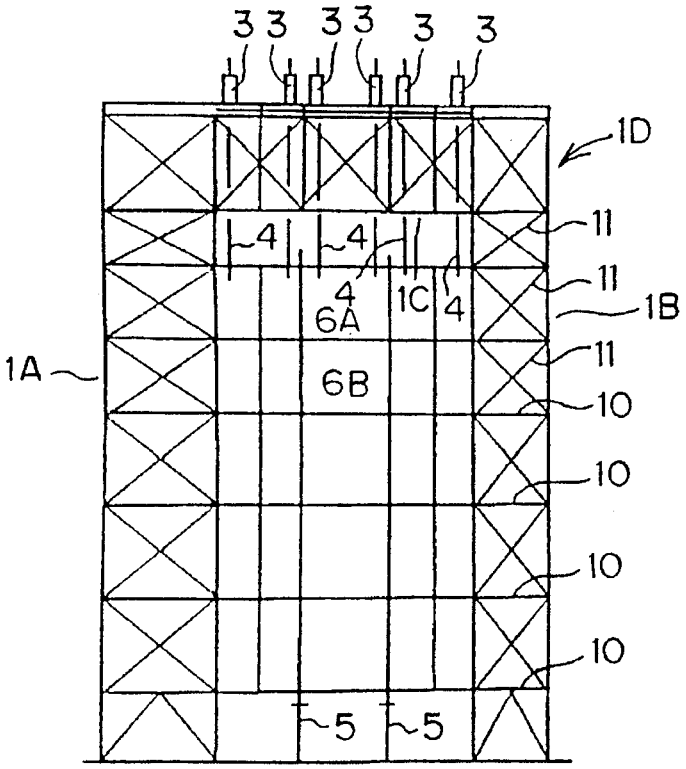
FIG. 14 is a view showing a state in which the assembly of the structure blocks under the gate-shaped truss assembly is completed.

Thus, after all blocks arranged between the truss column assemblies 1A and 1B are assembled as one unit, all blocks are jacked up as shown in FIG. 12. All blocks are raised until the floors in the truss column assemblies 1A and 1B coincides with the corresponding floors in the blocks, and the beam 10 and the horizontal brace 11 of each floor are aligned. For the block which has a long span and a problem of strength, jacking up is performed excessively, and lower short pillars 5 are installed under the lowermost block. Jacking down is performed until the lower short pillars 5 are subjected to a load to some extent, and the beam 10 and the horizontal brace 11 of each floor are aligned.

Figure 15:
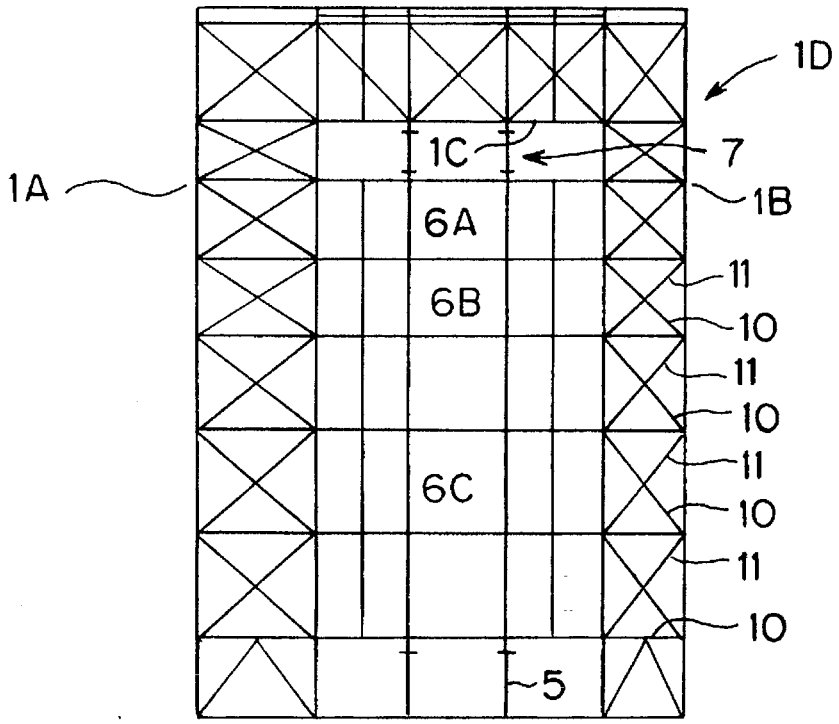
FIG. 15 is a view showing a state in which upper short pillars are inserted over the structure block of FIG. 14.

Depending on the load condition, upper short pillars 7 may be installed over the top block 6A as shown in FIG. 15. After the assembly of the gate-shaped truss assembly 1D and blocks 6A to 6C arranged between the truss column assemblies 1A and 1B is completed, the connecting passage 8, the temporary support frame 2, and jack rods 4 are removed.

Figure 18:
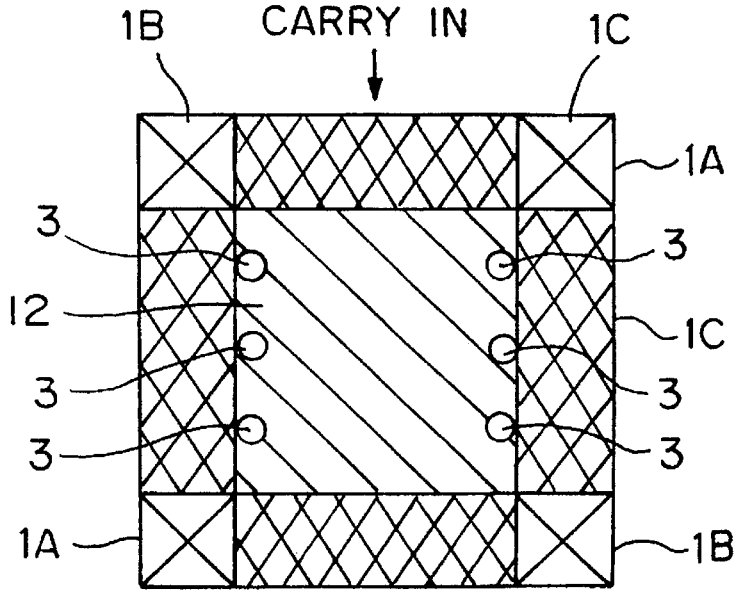
FIG. 18 is a view showing one embodiment in which modules are installed between the opposed gate-shaped truss assemblies.

In the above description, the assembly of the gate-shaped truss assembly, which is a basic element, and the flow of subsequent work in installing structure blocks in the construction zone located under the gate-shaped truss assembly has been explained. However, the entire steel structure is formed by these structures and modules installed in the construction zone between the gate-shaped truss assemblies arranged in opposition. This construction work proceeds for each zone formed by the longitudinal and transverse combination of gate-shaped truss assemblies. As an example, various combinations are shown in FIGS. 18 to 25. Among these examples, a typical example is shown in FIG. 18. In this example, when the gate-shaped truss assembly 1D is completed by assembling the basic structures, that is, the truss column assemblies 1A and 1B and the truss beam assembly 1C as shown in FIG. 4, a central room floor 12, which is installed between two gate-shaped truss assemblies arranged in opposition, can be carried in as a module from any direction of four sides depending on the carrying-in entrance.

That is to say, the carrying-in and installation of these modules can be performed by the same procedure as that for the installation of the blocks 6A, 6B, and 6C between the truss column assemblies 1A and 1B.

Next, a method for installing a module between the gate-shaped truss assemblies arranged in opposition will be described.

Figure 16:
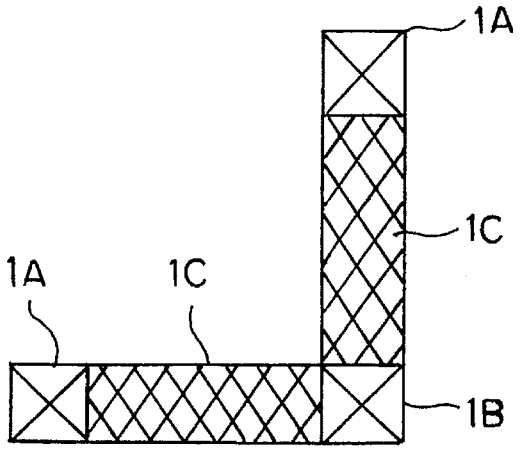
FIG. 16 is a view showing one embodiment of the installation of gate-shaped truss assembly.
Figure 17:
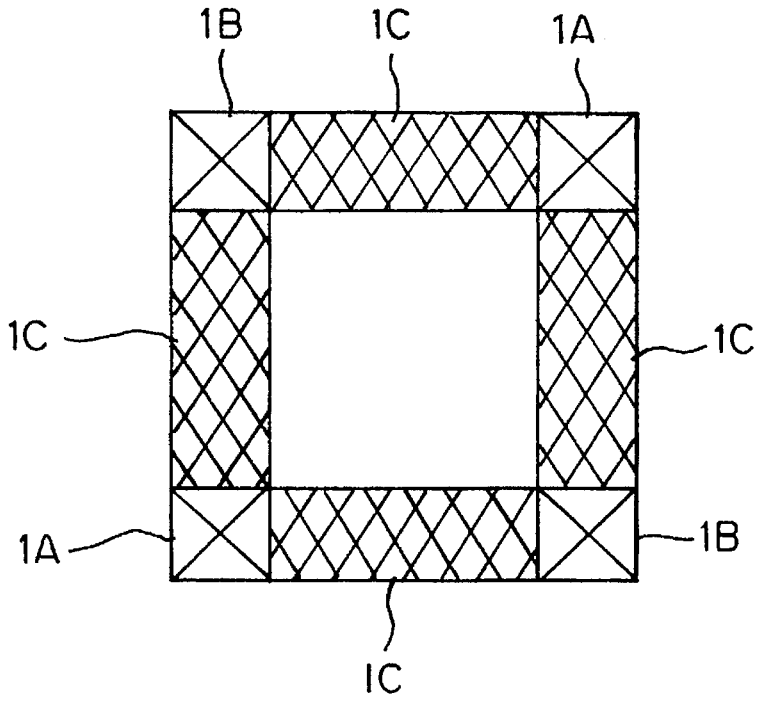
FIG. 17 is a view showing another embodiment of the installation of gate-shaped truss assembly.

The gate-shaped truss assemblies 1D are installed to fit in with the shape of the steel structure to be constructed, for example, as shown in FIGS. 16 and 17. At the upper part on the opposed side of the gate-shaped truss assembly 1D installed in opposition, a plurality of first elevating devices consisting of the jacks 3 and the jack rods 4 are arranged as shown in FIG. 18.

Depending on the weight of the floor 12 installed between the opposed gate-shaped truss assemblies 1D and the module consisting of various equipment, apparatuses, walls etc. installed on the floor, when the weight of the floor and module is heavy, the gate-shaped truss assembly 1D in the direction convenient for carrying-in should be one which has no blocks between the truss column assemblies 1A and 1B shown in FIG. 4 in accordance with the place where the steel structure is constructed. The gate-shaped truss assembly 1D which is at right angles to the above truss assembly and to which jacks 3 and jack rods 4 are mounted can incorporate all blocks under the gate-shaped truss assembly 1D shown in FIG. 15 and is reinforced. Then, both side ends of the first module consisting of the floor 12 etc. of the top floor on which carried-in members, equipment, and apparatuses between the gate-shaped truss assemblies 1D are connected, as shown in FIG. 5, to jack rods 4 hung from the tops of opposed gate-shaped truss assemblies 1D. In this case too, a frame similar to the temporary support frame 2 may be installed on top of the first module so that the jack rods 4 are connected to this frame.

Next, jacks 3 and jack rods 4 are driven simultaneously to lift the first module while keeping the horizontality of the module, like the case shown in FIG. 6, up to the height such that a second module located just under the first module can be carried in with a height margin. Then, the second module is carried in just under the first module, or the second module is assembled by using members, equipment, and apparatuses carried in just under the first module. After that, the first module, which has been jacked up with margin, is jacked down and placed on the second module. Then, the second module is joined to the first module for integration like the case shown in FIG. 8. Then, the integrated first and second modules are jacked up, like the case shown in FIG. 9, to a height which is required for the carrying-in or assembly of a third module located just under the second module, so that the third module is carried in or assembled under the integrated module. By repeating this process successively, all modules, which are arranged in the construction zone formed in the space between the opposed gate-shaped truss assemblies 1D, are assembled. Moreover, the floor surface of the structure block installed between the truss column assemblies 1A and 1B is positioned so as to coincide with the module floor surface, and joined. Thus, the assembly of modules is completed.

Figure 19:
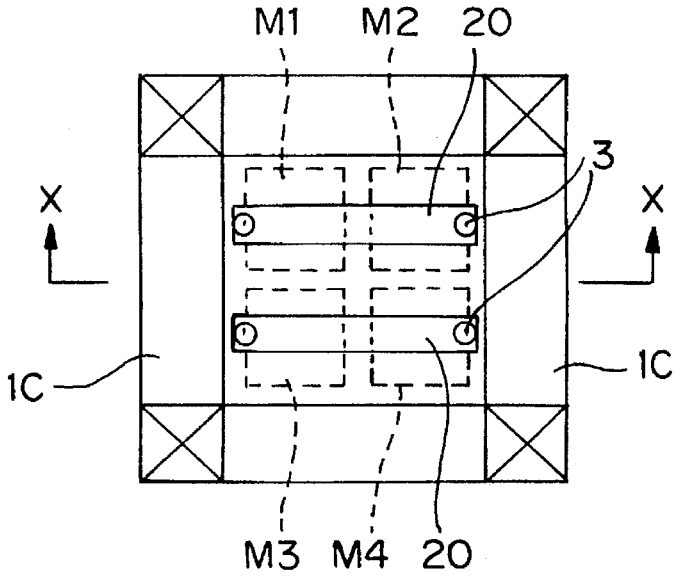
FIG. 19 is a plan view showing another embodiment in which modules are installed between the opposed gate-shaped truss assemblies.
Figure 20:
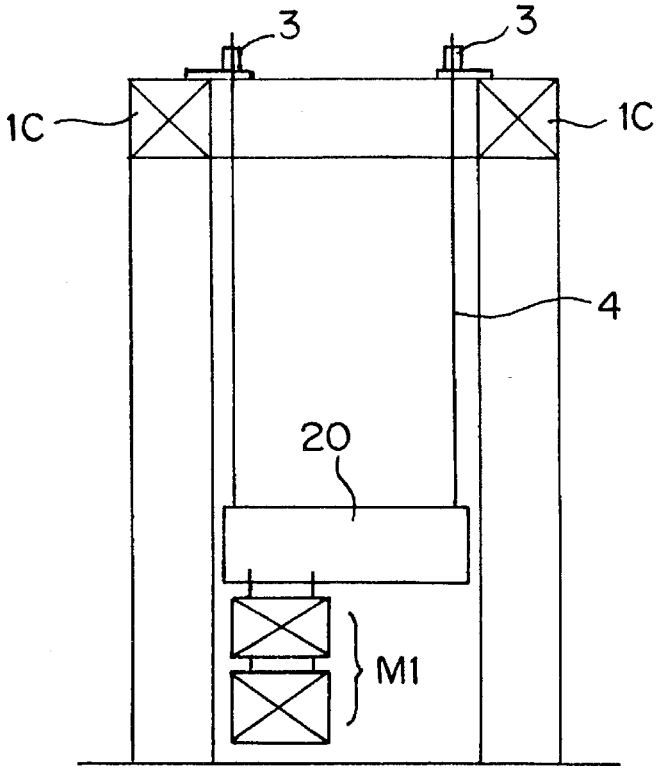
FIG. 20 is a front view along the line X—X of FIG. 19, showing the process for lifting a permanent support beam.
Figure 21:
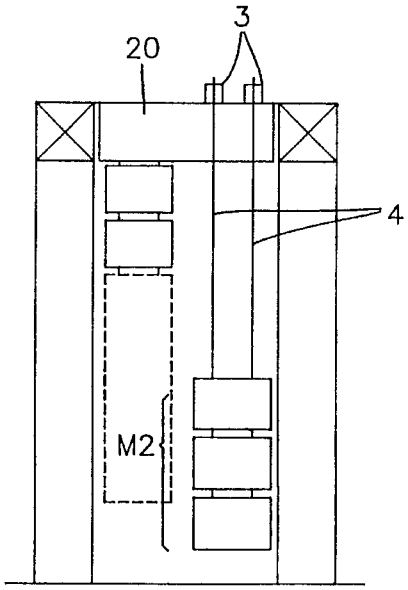
FIG. 21 is a front view showing a state in which the installation of permanent support beam is completed, and modules are installed under the beam.
Figure 22:
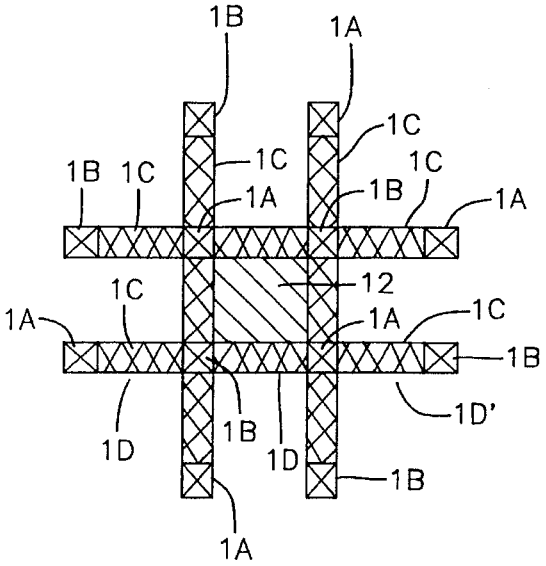
FIG. 22 is a view showing gate-shaped truss assemblies arranged surrounding the steel structure shown in FIG. 18.

FIGS. 19 to 21 show embodiments of a case where the construction zone formed between the gate-shaped truss assemblies 1D is wide and the module is too large, or the case where the weight of module is too heavy. The module installation work is performed as described below. Permanent support beams 20 are lifted between the gate-shaped truss assemblies 1D arranged in opposition by using the first elevating device provided at the side of the gate-shaped truss assembly 1D, and both ends of the support beam 20 are joined to the sides of the truss assemblies 1C. A module housed in the construction zone between the gate-shaped truss assemblies is divided into a plurality of modules (for example, M1 to M4) on a flat surface, and the divided modules are lifted by a second elevating device (jacks 3, jack rods 4) provided on each permanent support beam. With this method, a large size of module can be avoided, and the permanent beams 20 increase the strength of gate-shaped truss assemblies, so that safe, reliable module installation work can be done. In this embodiment, if several modules (M1) is connected to the lower part of the permanent support beam 20 in advance to an extent that the allowable lifting load is not exceeded, part of modules can be lifted together with the beam, so that the work efficiency can be further increased. Then, as shown in FIG. 22, new gate-shaped truss assemblies 1D' are constructed on the outside of the gate-shaped truss assemblies 1D between which modules have been assembled, to fit in with the shape and height of the steel structure, and modules are assembled between the opposed gate-shaped truss assemblies 1D', by which a required steel structure can be completed.

Figure 23:
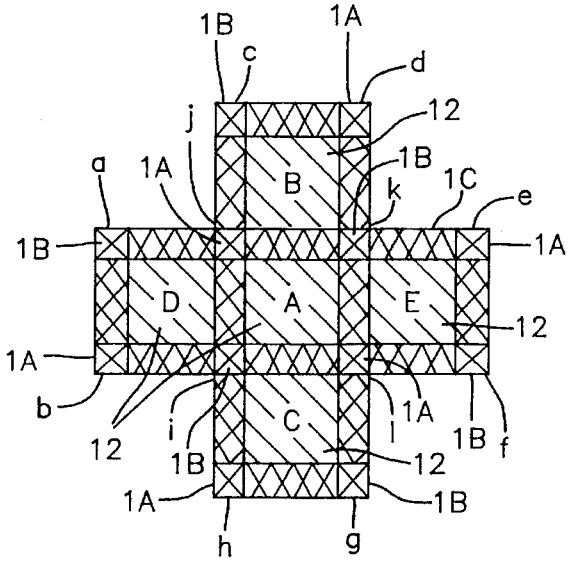
FIG. 23 is a view showing the construction process for a cross-shaped steel structure.
Figure 24:
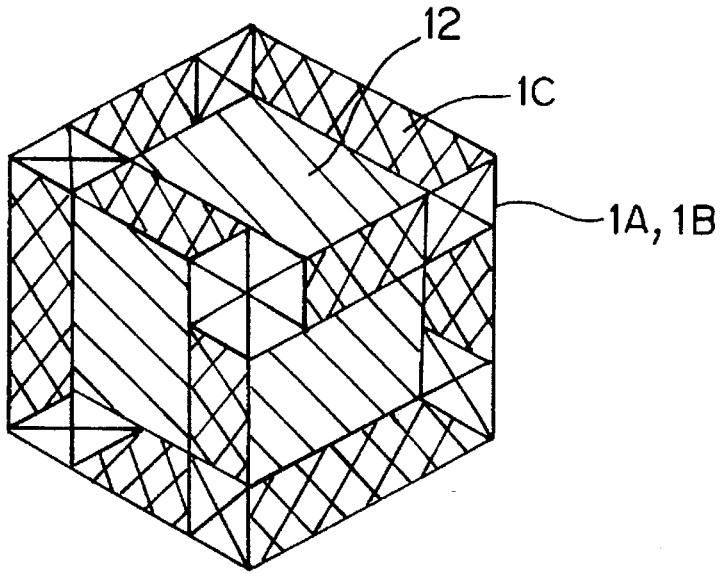
FIG. 24 is a view showing another embodiment in which modules are installed between the opposed gate-shaped truss assembly.
Figure 25:
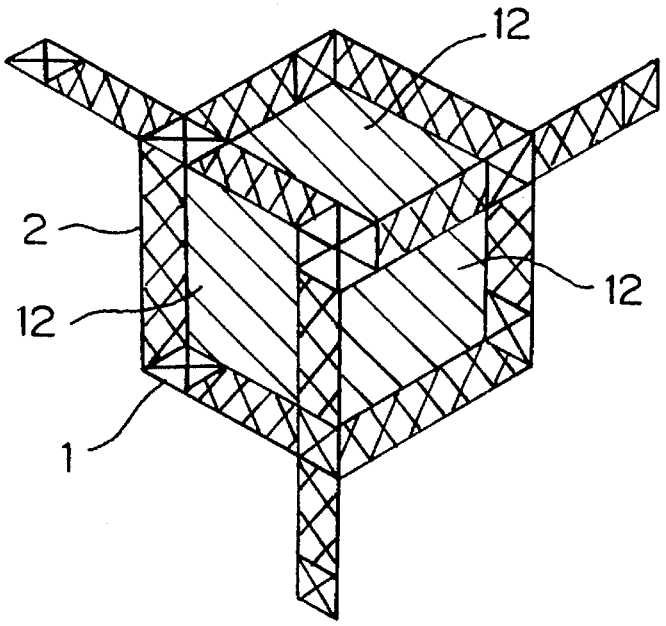
FIG. 25 is a view showing gate-shaped truss assemblies arranged on the outside of the structure shown in FIG. 24.
Figure 26:
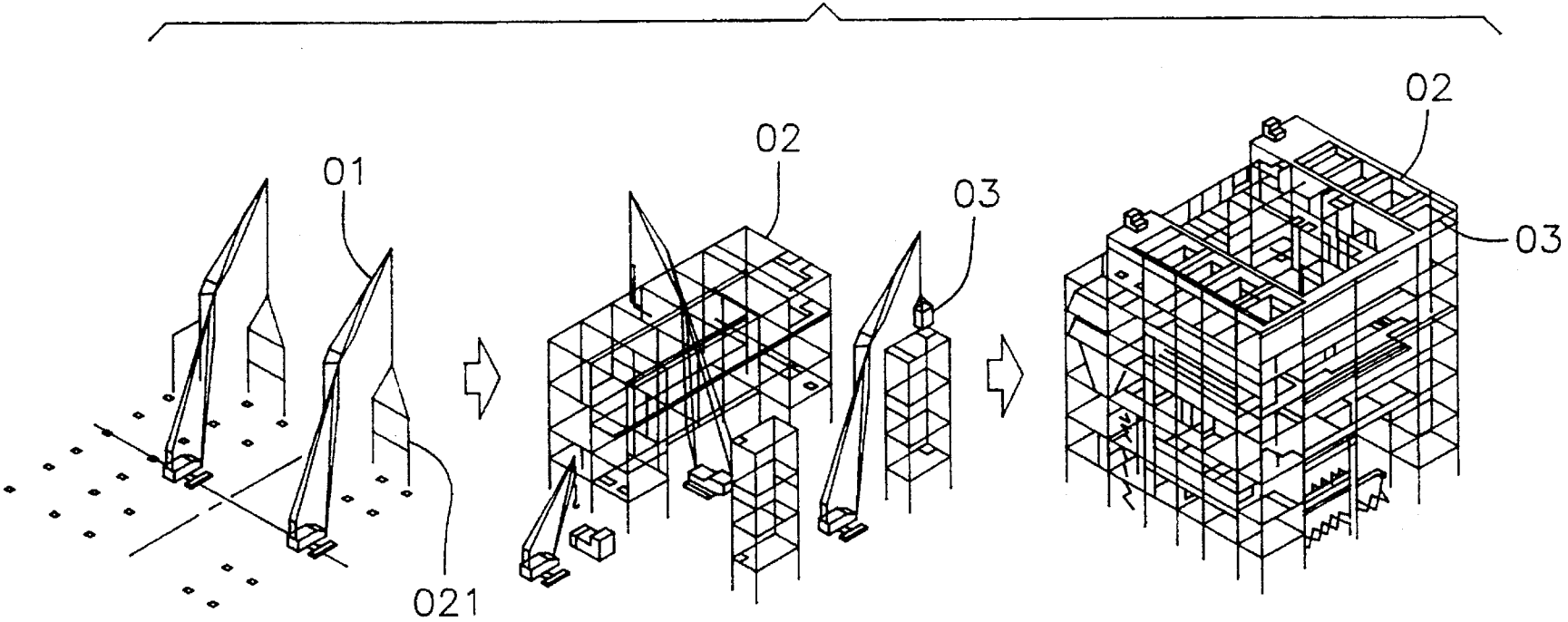
FIG. 26 is a view showing a conventional module construction method in a steel structure building zone of a pile-up system.
Figure 27:
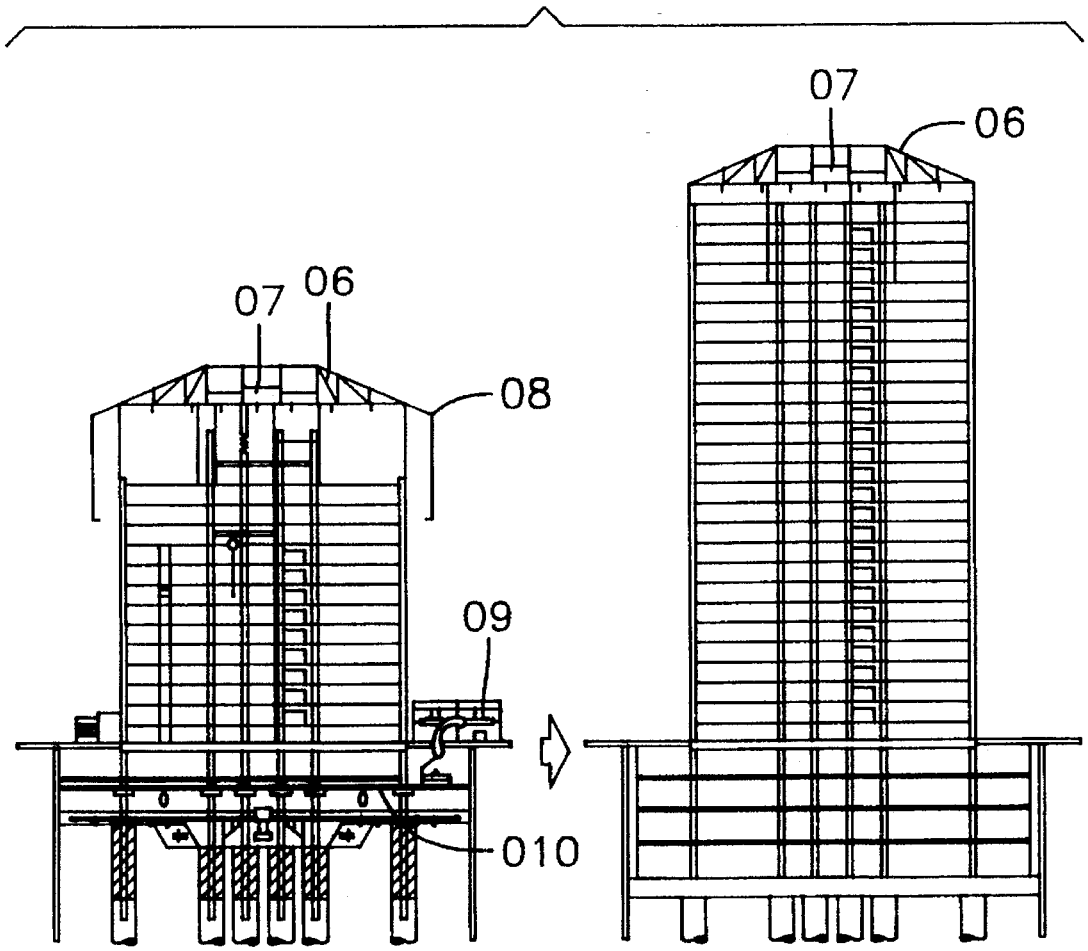
FIG. 27 is a view showing a conventional module construction method in a steel structure building zone of a push-up system.

FIG. 23 shows an installation procedure in constructing a cross-shaped steel structure. The installation sequence may be A, B, C, D, and E. Alternatively, the truss column assemblies a to l are erected in advance to fit in with the shape of the steel structure, and then a truss beam assembly 1C is installed between the tops of the adjacent truss column assemblies 1A and 1B to form a gate-shaped truss assembly. After that, modules in B, A, C or D, A, E construction zones are installed, and then modules in D, E or B, C construction zones are assembled. FIG. 24 shows an example in which the truss column assembly at the central portion is of a hexagonal shape, and rhombic truss column assemblies are installed surrounding the central truss column assembly to construct a steel structure. FIG. 25 shows a steel structure in which three rhombic truss column assemblies are installed outside the steel structure shown in FIG. 24 to provide a three-direction projecting structure.

INDUSTRIAL APPLICABILITY

As described above, the module construction method in a steel structure building zone is useful for assembly and construction work of a steel building in the case where the steel structure is very large, or there is no place where module is made block in advance because of limited work space, and also suitable for assembly and installation work of power generating sets, various steel making machines and paper making machines, and equipment and apparatuses for various chemical plants etc. which are installed the building.

We claim:

1. In a construction method for building a steel structure, a module construction method in a steel structure building zone, comprising the steps of:

erecting two truss column assemblies formed by arranging and joining a plurality of pillars;

installing a truss beam assembly between the tops of said two truss column assemblies erected in parallel to construct a gate-shaped truss assembly;

installing said gate-shaped truss assemblies in opposition to fit in with the shape of said steel structure by installing an upper surface of said two truss column assemblies at a same height as an upper surface of said truss beam assembly; and installing modules in the construction zone formed between said gate-shaped truss assemblies by repeating a process in which, among modules to be installed in the construction zone formed between said gate-shaped truss assemblies installed in opposition, a first module to be located at a high place is lifted to a required height by using a first elevating device installed at the upper part at the side of said gate-shaped truss assembly, and a second module is carried in just under said first module to integrate both modules.

2. In a construction method for building a steel structure, a module construction method in a steel structure building zone, comprising the steps of:

erecting two truss column assemblies formed by arranging and joining a plurality of pillars;

installing a truss beam assembly between the tops of said two truss column assemblies erected in parallel to construct a gate-shaped truss assembly;

installing said gate-shaped truss assemblies in opposition to fit in with the shape of said steel structure by installing an upper surface of said two truss column assemblies at a same height as an upper surface of said truss beam assembly;

lifting a permanent support beam by using a first elevating device installed at the upper part at the side of said gate-shaped truss assembly installed in opposition and joining both sides of said permanent support beam to the upper part at the side of said gate-shaped truss assembly; and installing modules in the construction zone formed between said gate-shaped truss assemblies by repeating a process in which, among modules to be installed in the construction zone formed between said gate-shaped truss assemblies installed in opposition, a first module to be located at a high place is lifted to a required height by using a second elevating device installed at the upper part at the side of said gate-shaped truss assembly, and a second module is carried in just under said first module to integrate both modules.

3. A module construction method in a steel structure building zone according to claim 1, wherein a step is added in which a structure block is installed in the construction zone under said gate-shaped truss assembly by repeating a process in which, among structure blocks to be housed in the construction zone formed under said gate-shaped truss assembly, a first structure block to be located at a high place is lifted to a required height by using said first elevating device, and a second structure block is carried in just under said first structure block to integrate both blocks.

4. A module construction method in a steel structure building zone according to claim 3, wherein a step is added in which after one of said modules or structure blocks manufactured in advance is installed in the construction zone, the other module or structure block is joined with beams and horizontal braces with the corresponding floor being at the same level.

5. A module construction method in a steel structure building zone according to claim 3, wherein the step for installing modules in the construction zone and the step for installing structure blocks are carried out independently in terms of time.

* * * * *